US007138624B2

(12) United States Patent
Kato

(10) Patent No.: US 7,138,624 B2
(45) Date of Patent: Nov. 21, 2006

(54) METHOD FOR ACCURATE MASS DETERMINATION WITH ION TRAP/TIME-OF-FLIGHT MASS SPECTROMETER

(75) Inventor: Yoshiaki Kato, Mito (JP)

(73) Assignee: Hitachi High-Technologies Corporation, Tokyo (JP)

( * ) Notice: Subject to any disclaimer, the term of this patent is extended or adjusted under 35 U.S.C. 154(b) by 14 days.

(21) Appl. No.: 11/016,848

(22) Filed: Dec. 21, 2004

(65) Prior Publication Data

US 2005/0151073 A1 Jul. 14, 2005

(30) Foreign Application Priority Data

Dec. 24, 2003 (JP) ..... 2003-426102

(51) Int. Cl.
*B01D 59/44* (2006.01)
*H01J 41/04* (2006.01)
*H01J 49/20* (2006.01)

(52) U.S. Cl. ..... 250/282; 250/281; 250/290; 250/292

(58) Field of Classification Search ..... None
See application file for complete search history.

(56) References Cited

U.S. PATENT DOCUMENTS 6,188,064 B1 2/2001 Koster
6,331,702 B1 * 12/2001 Krutchinsky et al. ..... 250/281
6,365,893 B1 4/2002 LeCocq
6,373,052 B1 4/2002 Hoyes et al.
6,680,475 B1 * 1/2004 Krutchinsky et al. ..... 250/281
6,972,408 B1 * 12/2005 Reilly ..... 250/292
7,078,685 B1 * 7/2006 Takada et al. ..... 250/292
2004/0144916 A1 * 7/2004 Krutchinsky et al. ..... 250/281
2004/0222369 A1 * 11/2004 Makarov et al. ..... 250/281
2005/0067565 A1 * 3/2005 Takada et al. ..... 250/292
2005/0092910 A1 * 5/2005 Geromanos et al. ..... 250/282
2005/0151073 A1 * 7/2005 Kato ..... 250/287

(Continued)

FOREIGN PATENT DOCUMENTS

JP 11-1584486 A 6/1999

(Continued)

OTHER PUBLICATIONS

G. Hopfgartner et al., "Exact Mass Measurement of Product Ions for the Structural Elucidation of Drug Metabolites with a Tandem Quadrupole Orthogonal-Acceleration Time-of_Flight Mass Spectrometer," Journal of America Society for Mass Spectrometry, 10 (1999), pp. 1305-1314.

*Primary Examiner*—Nikita Wells
*Assistant Examiner*—Bernard E. Souw
(74) *Attorney, Agent, or Firm*—Dickstein Shapiro LLP

(57) ABSTRACT

Accurate mass measurement is carried out for product ions of a sample. A method for accurate mass determination of ions with Trap-TOF/μs includes steps of generating ions of an analyte sample and a standard material; introducing the ions of the analyte sample and the standard material together into an ion trap to trap them; selecting a precursor ion from the ions of the analyte sample to leave the precursor ion and a standard material ion in the ion trap and eliminate other ions; exciting and dissociating the precursor ion to generate product ions; ejecting the precursor ion, its product ions, and the standard material ion trapped in the ion trap to introduce these ions into the TOF mass spectrometer; and measuring a mass spectrum with the TOF mass spectrometer, where correction for accurate masses of the product ions is carried out based on the standard material ion measured.

10 Claims, 3 Drawing Sheets

U.S. PATENT DOCUMENTS

2005/0253060 A1* 11/2005 Mimura et al. ..... 250/281

FOREIGN PATENT DOCUMENTS

JP 2001-028252 A 1/2001
JP 2001-074697 A 3/2001
JP 2003-123685 A 4/2003

* cited by examiner

FIG. 2 A
FIG. 2 B
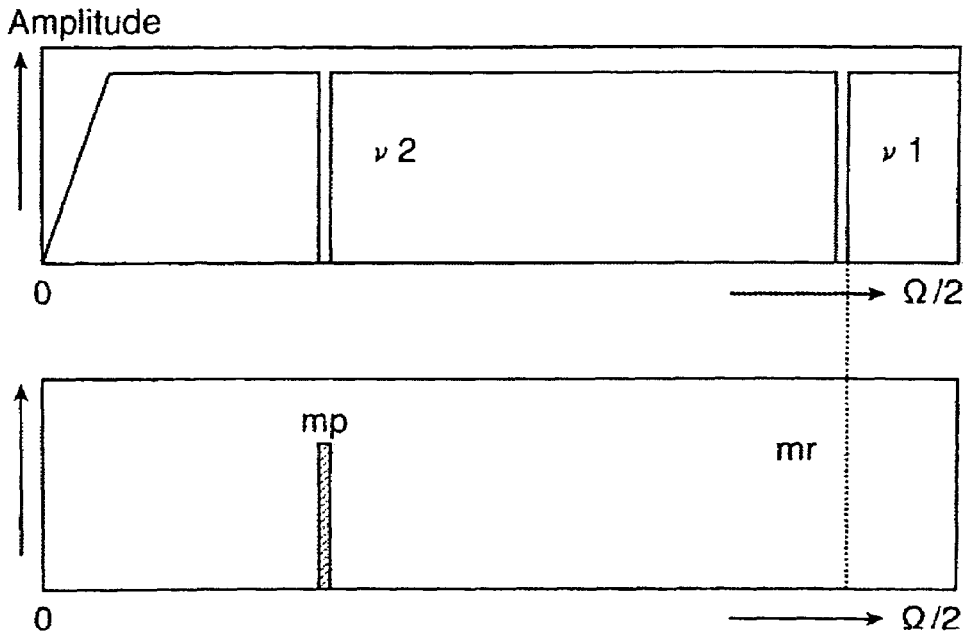
FIG. 3 A
FIG. 3 B
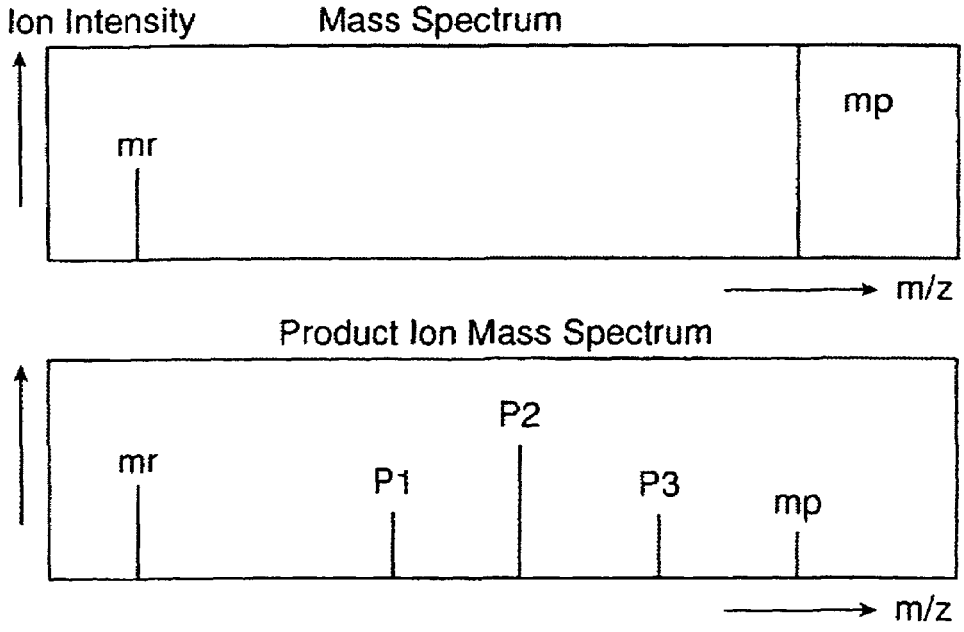

METHOD FOR ACCURATE MASS DETERMINATION WITH ION TRAP/TIME-OF-FLIGHT MASS SPECTROMETER

FIELD OF THE INVENTION

The present invention relates to an instrument in a combination of two mass spectrometers, an ion trap type and a time-of-flight type, and more particularly to a method for analysis with the use of this instrument.

BACKGROUND OF THE INVENTION

Accurate mass determination is a technology in which a mass of an ion is determined with a mass spectrometer with an accuracy of $1/10^6$, that is, an accuracy at ppm level, and an elemental composition of the ion is determined based on this accurate mass. Structural elucidation of a sample molecule is carried out from the determined elemental composition of the ion. Since a molecular formula is directly determined, this technology also makes a significant contribution to accurate identification and analysis of molecular structure of an unknown component. Mass spectrometers that can perform accurate mass determination are a double-focusing magnetic sector mass spectrometer, a time-of-flight mass spectrometer (so-called TOF), and the like.

In particular, TOF that has been developed includes a quadrupole-TOF (Q-TOF) arranged with two quadrupole mass spectrometers (QMS) and an ion trap-TOF in which an ion trap composed of a ring electrode and a pair of endcap electrodes and a TOF are combined. The use of these TOFs enables accurate mass determination in an ordinary mass spectral measurement.

An example of Q-TOF is disclosed in JP-A No. 154486/1999 (Patent Document 1), and that of ion trap-TOF is disclosed in JP-A No. 123685/2003 (Patent Document 2).

In the accurate mass determination with TOF, work of mass calibration for values obtained with the instrument becomes necessary for improvement of accuracy.

When a singly-charged ion with a mass of M is accelerated with an acceleration voltage U, the ion flies through vacuum at a velocity v. The velocity v is evaluated by the following equation:

$$v=1.39*10^4\sqrt{(U/M)} \quad (1)$$

When the ion is assumed to require a time t (second) to fly through the flying space of TOF with a length of L (meter), t is determined by Equation 2 below.

$$t=L/v=L/(1.39*10^4\sqrt{(U/M)})=k\sqrt{(M)} \quad (2)$$

where k is a characteristic constant of the instrument. Namely, the flight time t of the ion is proportional to the square root of its mass. In a practical TOF instrument, the relationship between the flight time of the ion, i.e. the detection time t of the ion, and M is approximated by the following equation:

$$M=at^2+bt+c \quad (3)$$

where a, b, and c are constants. That is, a quadratic equation is derived for the relation between the ion mass M and the detection time t. The process to determine the relation (Equation 3) is mass calibration.

In the mass calibration, a standard material that gives a plurality of ions with known masses is introduced into TOF, followed by measurement of mass spectrum. The constants, a, b, and c in Equation 3 can be determined using the detection times t of the product ions and the known masses M. Accordingly, a substance that gives ions with known masses in a wide mass range is used for the standard material.

After completing the mass calibration, a practical sample is measured, and the mass M0 of the sample ion can be determined from the detection time t0 of the ion according to Equation 3. The mode in which the mass calibration with the standard material and the measurement of the practical sample are independently carried out with a time interval is called external reference method. An example of the external reference method is disclosed in JP-A No. 74697/2001 (Patent Document 3).

In general, the accuracy of mass determined by this external reference method is, however, only at most 30 to 100 ppm (ppm=$10^{-6}$). The poor accuracy is caused by drifts in expansion and contraction of flight space L in TOF due to changes in temperature surrounding the instrument and the like, and by drifts in an acceleration voltage U, an electrostatic lens voltage, and the like. With such accuracy, it is not possible to determine an elemental composition univocally from the determined mass M.

The determination of elemental composition with little possibility of error requires accuracy of 5 ppm or lower. In order to insure this level of accuracy in the determination, it is necessary to inject ions of a standard material together with those of an analyte sample into TOF and measure them at the same time. Ions arising from the standard material have known masses, and these ions are called lock mass ions. Generally, this method is called internal reference method. This internal reference method allows not only temperature drift and the like to be compensated but also determination to be always performed with high accuracy. Furthermore, the internal standard material injected with the analyte sample into an ion source of TOF is not required to generate ions in a wide mass range, thereby facilitating selection of the standard material. An example of the internal reference method is disclosed, for example, in JP-A No. 28252/2001 (Patent Document 4).

Hence, the internal reference method is a method essential for improvement in accuracy of determination. However, in the case of TOF that has a function of performing MS/MS such as Q-TOF in which two QMSs are arranged in prestages of TOF, mass calibration by means of the internal reference method cannot be applied for accurate mass determination of product ions obtained by MS/MS analysis. This is because, when a precursor ion is isolated in a first QMS, the lock mass ions of a standard sample having been introduced with an analyte sample are removed by the first QMS and are not introduced into the TOF with the product ions at the same time. Owing to the lack of the lock mass ions in the mass spectrum of the product ions, accurate mass determination by the internal reference method becomes impossible.

An example to address this problem by focusing on a precursor ion during MS/MS is disclosed in Journal of American Society for Mass Spectrometry, 10 (1999), 1305–1314 (Non-patent Document 1). Specifically, the procedure is as follows:

Accurate mass determination of an unknown sample is carried out in advance by an ordinary method (determination without MS/MS measurement), and the accurate mass of an ion to be selected for the precursor ion is determined. Then, MS/MS measurement is performed for the selected precursor ion (isolation of the ion, collision-induced dissociation (CID), measurement of product ions), and the precursor ion slightly remaining on the mass spectrum of the product ions is used as the lock mass ion, thereby carrying out mass calibration of the product ions.

[Patent Document 1] JP-A No. 154486/1999

[Patent Document 2] JP-A No. 123685/2003

[Patent Document 3] JP-A No. 74697/2001

[Patent Document 4] JP-A No. 28252/2001

[Non-patent Document 1] Journal of American Society for Mass Spectrometry, 10 (1999), 1305–1314

In the above method according to Non-patent Document 1, however, accurate mass determination of an unknown sample must be performed first by an ordinary MS mode. Then, various parameters of Q-TOF are changed to switch to a MS/MS mode, followed by MS/MS measurement. That is, the ordinary accurate mass determination and the MS/MS measurement must be conducted separately at a time interval. This method is considered as a kind of the external reference method, and thus highly accurate determination is difficult because error is duplicated. Moreover, when a plurality of unknown analyte samples are injected into the mass spectrometer one after another in a short time as in the case of LC/MS analysis, it is difficult to apply the method of Non-patent document 1.

Although Q-TOF allows MS/MS measurement, there is no report, other than Non-patent document 1, that is concerned with a mode to perform accurate determination of product ions in MS/MS measurement. Furthermore, though Q-TOF allows MS/MS measurement, it is not possible to perform $MS^n$ measurement that enables higher structural information to be acquired. Naturally, accurate mass determination by $MS^n$ is impossible with Q-TOF.

SUMMARY OF THE INVENTION

The present invention was carried out to solve these problems, and the main objective is to provide a method for accurate mass determination with the ion trap/time-of-flight mass spectrometer that enables accurate mass determination of product ions and improvement in the accuracy of MS/MS and further $MS^n$.

In order to achieve the above objective, one aspect of the present invention in the method for accurate mass determination of ions with the ion trap/time-of-flight mass spectrometer that is provided with an ion source to ionize the sample, an ion trap including a ring electrode and a pair of endcap electrodes, and a time-of-flight mass spectrometer includes steps of determining the constants a, b, and c in Equation 3; injecting ions of a standard material and an analyte sample and performing MS/MS for the analyte sample ion; and carrying out correction of product ions obtained by MS/MS.

Another aspect of the present invention includes steps of injecting ions of the standard material and the analyte sample and performing MS/MS for ions of the standard material and the analyte sample together; and carrying out correction of product ions of the latter obtained by MS/MS.

According to the present invention, accurate mass determination of the product ions generated by MS/MS or $MS^n$ can be achieved by the internal reference method with high accuracy.

BRIEF DESCRIPTION OF THE DRAWINGS

FIG. 2A depicts a power spectrum of a supplementary AC voltage for use in ion isolation in a first embodiment;

FIG. 2B depicts collision induced dissociation (CID) excitation of a precursor ion in the first embodiment;

FIG. 3A is a mass spectrum of isolated ions in the first embodiment;

FIG. 3B is a mass spectrum of product ions after the CID excitation in the first embodiment;

DETAILED DESCRIPTION OF THE PREFERRED EMBODIMENTS

Embodiments of an ion trap/time-of-flight mass spectrometer according to the present invention are explained below. For simplification of the explanation, polarity of sample ions is kept positive in the explanation.

First Embodiment

Figure 1:
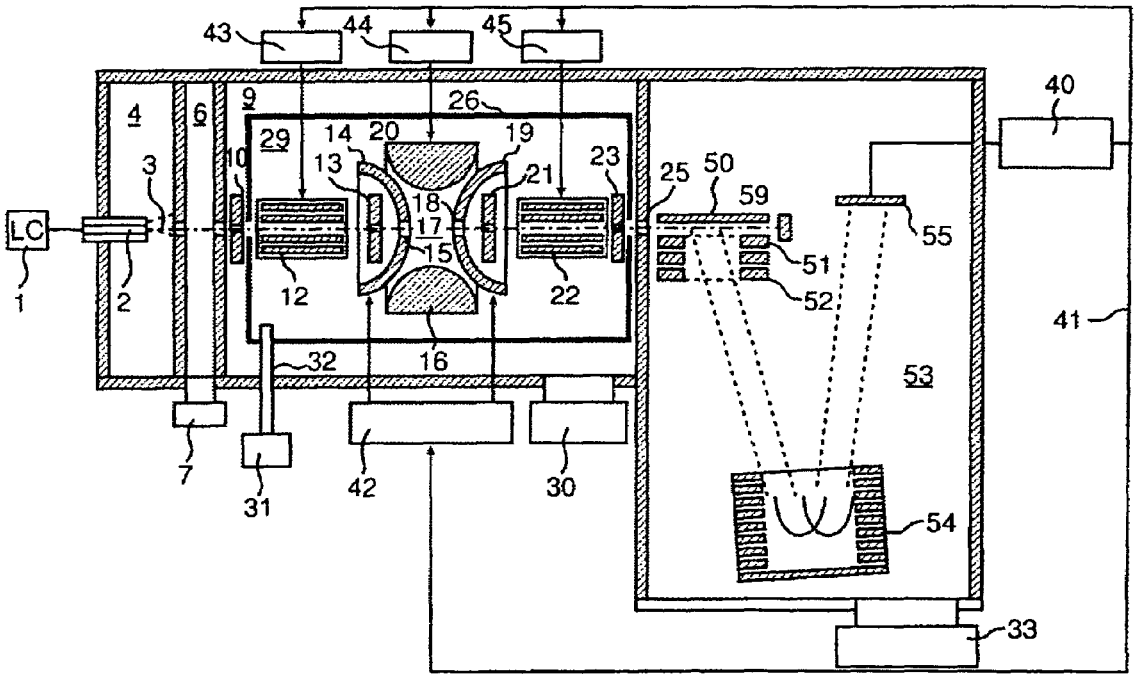
FIG. 1 depicts a schematic structure of an ion trap/time-of-flight mass spectrometer of the present invention.

One embodiment of the present invention is explained referring to FIGS. 1 to 3.

A sample solution transferred from a liquid chromatograph (LC) 1 is introduced into a nebulizer probe 2 of an ESI ion source, sprayed into the atmosphere 4 as positively charged fine droplets, and ionized. The generated ions are introduced into a high vacuum chamber 9 evacuated with a turbo molecular pump (TMP) 30 via an intermediate pressure chamber 6 evacuated with an oil rotary pump (RP) 7. The ions are accelerated by a direct-current voltage applied to an ion acceleration electrode 10 and injected into an ion transmission space 29 through an aperture on an ion transmission housing 26 that is a metallic shield cylinder placed in the high vacuum chamber 9. In the ion transmission housing 26, a first multipole ion guide 12, an ion trap 20, and a second multipole ion guide 22 are arranged in tandem.

Here, the first multipole ion guide 12 plays a role in transmitting the ions generated by the atmospheric pressure ion source to the ion trap 20 with high efficiency. On the other hand, the second multipole ion guide 22 plays roles as an ion shutter to switch on/off an ion current and an ion guide to transmit the ions to TOF while switching between these two roles with synchronizing to the operation of the ion trap 20.

The first multipole ion guide 12, the ion trap 20, and the second multipole ion guide 22 are placed in the metallic ion transmission housing 26. An inert gas, such as He, Ne, Ar, Xe, or nitrogen gas, is introduced alone or as a mixture of them from a gas inlet system 31 into the inside of the metallic ion transmission housing 26 through a pipe 32. The gas is supplied from the gas inlet system 31 so that the pressure in the ion transmission space 29 is adjusted to $10^{-1}$ to $10^{-3}$ Torr (from 100 mTorr to 1 mTorr).

The ions introduced into the ion transmission space 29 pass through the first multipole ion guide 22 and is guided from an aperture 15 bored through the center of an endcap electrode 14 of the ion trap 20 into an ion trapping volume 17 with high efficiency. The ion trap 20 is constructed from a doughnut-shaped ring electrode 16 and two endcap electrodes 14 and 19. The ring electrode 16 is applied with a main radio-frequency (RF) voltage (ca. 1 MHz, a few kV) supplied from a main RF power supply 44. As the result, a quadrupole high frequency field is generated in the ion trapping volume 17, and the introduced ions are stably trapped owing to this quadrupole high frequency field. The trapped ions, after being subjected to the process of removal of unnecessary ions and MS/MS or $MS^n$, are ejected from the ion trapping volume 17 through an aperture 18, and introduced into the second multipole ion guide 22. The ions collide here with the introduced inert gas molecules repeatedly to lose their kinetic energy, resulting in a decrease of the kinetic energy up to thermal motion energy level. The ions that lost the kinetic energy is focused on the central axis of the ion guide by a high frequency field that is generated by a high frequency applied to the second multipole ion guide 22. This is called thermalization. The thermalized ions diffuse little by little and are ejected from the ion transmission housing 26 to its outside.

The ions are then introduced into a vacuum TOF space 53 evacuated highly with a turbo molecular pump (TMP) 33. In the TOF space 53, a pulser 59 that carries out generation of ion packet and acceleration of the ions, a reflector 54, and a detector 55 are placed. The ions travel between an ion repeller electrode 50 and an ion extraction electrode 51. The ions are deflected in the direction perpendicular to their incoming direction, i.e. TOF flight axis, by positive and negative pulse voltages applied between the ion repeller electrode 50 and the ion extraction electrode 51. Further, the ions enter into an inner space of an ion acceleration electrode 52 to be accelerated finally, and are ejected into the TOF space 53. The ions fly through the TOF space 53, are reflected from the reflector 54, and arrive at the detector 55, by which ion currents corresponding to the flight times t are measured respectively to provide a mass spectrum after being processed with a data processing unit 40.

The foregoing is a basic flow of measurement with the ion trap/time-of-flight mass spectrometer. In the present embodiment, the process is carried out according to the following steps using the ion trap/time-of-flight mass spectrometer.

Step 1: Calculation of parameters (a, b, and c in Equation 3)

Step 2: Simultaneous measurement of a standard material and an analyte sample, and MS/MS Step 3: Mass calibration of product ions obtained by MS/MS Hereinafter, these steps are described in detail.

Step 1: Calculation of Parameters (a, b, and c in Equation 3)

First, a standard material is measured by an ordinary MS mode to perform mass calibration, and each constant of a, b, and c in Equation 3 ($M=at^2+bt+c$) is calculated. For this purpose, it is necessary to use a standard material that gives at least three ions with known masses.

Items required for the standard material for mass calibration are listed below.

A) The structure of the standard material is known, and its ion has a single and known elemented-composition. Accurate masses of the ions can be determined accurately.

B) Ions with known masses appear at intervals as evenly spaced as possible over a wide mass range.

C) The standard material does not interfere with sample ionization.

A method of using a cluster ion that is readily available and applicable to a wide mass range as the standard material that meets approximately the above conditions is described below.

For example, when trifluoroacetic acid sodium salt is dissolved in a solution of water and methanol and injected into the ESI ion source, cluster ions corresponding to $(CF_3COONa)_nNa^+$(n=1 to 20) appear every 136 mass up to a mass of 2,000 or more. That is, mass peaks having masses of 159, 295, 431, . . . 1383, . . . 2743 appear so as to be evenly spaced in an equal mass in a wide mass range. The masses Mr (true value) of these ions can be simply determined by the following equation:

$$Mr=(24+18.998405*3+15.994915*2+22.98977)*n+22.98977 \quad (4)$$

Similarly, halogenated alkali metal salts such as CsI, CsF, and NaF also provide cluster ions $(M_{n+1}X_n)^+$ in a wide mass range. These ions are known in terms of their compositions, allowing accurate ion masses to be provided accurately. CsI yields cluster ions every 260 mass at 133, 393, 653, etc. CsF yields cluster ions every 152 mass at 133, 285, 437, etc. NaF yields cluster ions every 42 mass at 23, 65, 107, etc.

The standard material can be selected for use depending on the mass of an analyte sample ion.

Mass calibration is carried out by using these standard ions, and thus the constants a, b, and c in Equation 3 can be calculated.

Step 2: Simultaneous Measurement of the Standard Material and an Analyte Sample, and MS/MS When mass calibration is completed in Step 1, the measurements in Step 2 are undertaken, with the use of the standard material used in Step 1 and an analyte sample, in the following order: 1) injection of ions into ion trap, 2) MS/MS, and 3) TOF measurement. This step is explained below.

1) Introduction of Ions into the Ion Trap 20

Since an internal reference method is used in the present invention, ions of the analyte sample and the standard material generated by the ion source are injected in their mixed state into the high vacuum chamber 9 through the intermediate pressure chamber 6. For ionization and injection of the analyte sample and the standard material, these two individual solutions may be simultaneously injected into one ESI ion source to be mixed, and ionized at the same time. Alternatively, a plurality of ion sources are prepared, and the solutions of the analyte sample and the standard material are injected into individual ESI ion sources, ionized each independently, followed by mixing the individually generated ions and introducing to the high vacuum chamber 9 together.

The ion acceleration electrode 10 is applied with an acceleration voltage of ca. −100 V. The introduced ions are accelerated, and introduced into the ion transmission space 29 through the aperture bored through the center of the ion acceleration electrode 10. The ions are introduced into the first multipole ion guide 12. The electrode constituting the first multipole ion guide 12 is applied with a high frequency voltage (1 to 2 MHz, 1 to 2 kV) from a high frequency power supply 43. Into the ion transmission space 29 is introduced an inert gas from the gas inlet system 31, and its pressure is maintained at approximately $10^{-1}$ to $10^{-3}$ Torr. The ions guided into the first multipole ion guide 12 is thermalized in the first multipole ion guide 12 and gradually focused on the central axis of the ion guide. The ions that lost most of their kinetic energy are accelerated by an ion gate voltage of ca. −100 V applied to an ion gate electrode 13 and then introduced from the aperture 15 bored through the center of the endcap electrode 14 of the ion trap 20 into the ion trapping volume 17. That is, the ion gate is in an open state. A main RF voltage is applied to the ring electrode 16 from the main RF power supply 44. The ions of the analyte sample and those of the standard material are stably trapped together in the ion trapping volume 17 by a quadrupole RF field that is generated in the ion trapping volume 17 by applying the main RF voltage. The ions of the analyte sample and those of the standard material that are continuously introduced are accumulated in the ion trapping volume 17.

2) MS/MS

In this MS/MS step, an ion of the analyte sample having a specified mass (precursor ion) and an ion of the standard material among the ions that have been trapped in the ion trap 20 are isolated within the ion trap by a known method, and then the precursor ion is resonancely excited to dissociate it.

This MS/MS step can be omitted if unnecessary in analysis. In this case, the process is carried out from 1) to 3) directly.

The MS/MS step is carried out according to the two steps: (a) and (b) below.

(a) Isolation of the Precursor Ion and the Standard Material Ion

First, a voltage (+100 V) of the same polarity as that of the ions is applied to the ion acceleration electrode 10 and the ion gate electrode 13 during MS/MS, thereby preventing the ions from entering into the ion transmission space 29 (close state). The ions trapped in the ion trap 20 in the previous step 1) are excited by applying white noise with a plurality of notches, according to known filtered noise field (FNF) or stored waveform inverse Fourier transform (SWIFT), as a supplementary AC voltage to the endcap electrodes 14 and 19.

Here, ion isolation by FNF is explained referring to FIG. 2. A power spectrum of the supplementary AC voltage applied at the time of ion isolation is shown in FIG. 2A. The horizontal axis indicates the supplementary AC frequency, and the vertical axis indicates the supplementary AC voltage (amplitude). Ω is the frequency of the main RF voltage applied to the ring electrode. Namely, the frequency of the supplementary AC voltage (white noise) applied for ion isolation includes frequency components ranging from 0 to Ω/2. This white noise lacks a plurality of frequency components (ν1, ν2). These two lacking frequency components are called notches. In the present embodiment, only the standard material ion (mr) and the precursor ion (mp) that have secular motion corresponding to the plurality of notches (ν1, ν2) respectively are left in the ion trapping volume 17. The ion selected for the precursor ion is that of the analyte sample to be measured. When the mass number of that ion is known in advance, the ion is set as the precursor ion based on the mass number. In the case of an unknown sample, the precursor ion is determined after acquiring an approximate mass number by a measurement performed once in advance.

When the standard material ion (mr) is one, white noise with two notches (ν1, ν2) corresponding to the precursor ion (mp) and the standard material ion (mr) is applied.

Mass ions other than the standard material ion and the precursor ion are excited by the white noise and ejected from the aperture 18 on the endcap electrode 19 to the outside.

(b) Excitation of Precursor Ion (mp) and Collision Induced Dissociation (CID)

After only the precursor ion (mp) and the standard material ion (mr) are left behind in the ion trap 20, a supplementary AC voltage with a frequency identical to or close to the secular motion ν2 of the precursor ion (mp) is applied to the endcap electrodes 14 and 19 from a supplementary AC power supply 42 as shown in FIG. 2B. The precursor ion (mp) resonates with the applied supplementary AC voltage, resulting in an increase in its amplitude of the motion. The ion collides repeatedly with inert gas molecules in the ion trapping volume 17, thus incorporating a portion of the kinetic energy as its internal energy. When the internal energy due to excitation exceeds the chemical bond energy of the molecule, the precursor ion (mp) dissociates (CID). The resulting product ions (P1, P2, P3) are trapped in the ion trapping volume 17. On the other hand, the standard material is not excited, and therefore, it remains to be stably trapped in the ion trapping volume irrespective of the CID of the precursor ion (mp).

A mass spectrum in the case where the precursor ion (mp) and the standard material ion (mr) were isolated is shown in FIG. 3A. Further, a mass spectrum of the product ions generated when the precursor ion (mp) was dissociated by the CID is shown in FIG. 3B. The precursor ion (mp) that could not be totally dissociated by the CID remains, and its product ions (P1, P2, P3) appear newly on the mass spectrum. The intensity of the standard material ion (mr) keeps the original intensity irrespective of the CID step.

It should be noted that MS/MS step can be pursued further to $MS^3$, $MS^4$, . . . , $MS^n$ by repeating the steps of (a) and (b). While performing these steps, the standard material ion (mr) remains trapped in the ion trapping volume. During the MS/MS step, the second multipole ion guide 22 keeps playing a role as the ion shutter (OFF).

3) TOF Measurement

The product ions (P1, P2, P3) generated by the MS/MS as shown in FIG. 3B are trapped in the ion trap. The standard material ion (mr) is also trapped as it has been. Next, these ions are ejected from the ion trap and sent into TOF to obtain their mass spectrum.

When the ions are ejected from the ion trap at a stroke, first, the main RF supplied from the main RF power supply 44 is shut off, followed by switching to a direct-current voltage of +10 V. At the same time, a direct-current voltage of +100 V is applied to the first endcap electrode 14, and a direct-current voltage of −100 V is applied to the second endcap electrode 19. These voltages may be applied in pulses of ca. 1 msec or continuously for 20 msec to 30 msec. As the result, the electric field in the ion trapping volume 17 is switched from a quadruple RF field to a direct current field. The ions having been present around the center of the ion trapping volume 17 are accelerated toward the second endcap electrode 19 and ejected from the aperture 18 to the outside of the ion trap.

The ejected ions are decelerated at an electrode 21, and then introduced into the second multipole ion guide 22. To the second multipole ion guide 22 is applied an RF voltage supplied from an RF power supply 45. The ions are thermalized in the second multipole ion guide 22, resulting in being focused along the central axis of the ion guide 22. Although the ions are ejected from the ion trap 22 in pulses, the second multipole ion guide 22 allows these ions to remain widely distributed around the central axis of the ion guide and to be gradually ejected toward TOF on account of a potential difference between the electrodes 21 and 23. Thus, these ions result in forming a quasi-continuous flow and are sent into TOF.

The ions introduced into the highly evacuated TOF space travel straight between the ion repeller electrode 50 and the ion extraction electrode 51. Positive and negative direct-current voltages are applied in pulses (ca. nsec) to the ion repeller electrode 50 and the ion extraction electrode 51 of TOF, respectively, thereby deflecting the ions in the direction perpendicular to their incoming direction. In this way, the ions are sampled from the quasi-continuous flow in pulses, i.e., in ion packets, and subjected to TOF measurement. The ion packet deflected in the perpendicular direction is accelerated by an acceleration voltage (ca. 4 kV) applied to the ion acceleration electrode 52 and ejected into the TOF space 53. The ions are reflected from the reflector 54 and arrive at the detector 55, by which ion currents corresponding to the ion arrival times are detected. TOF measurement is repeatedly carried out during the step 3), and acquired data are integrated to provide a mass spectrum.

During this period, the second multipole ion guide 22 plays a role as an ion guide to thermalize and transmit ions.

By the foregoing procedures, one cycle of the measurement is completed, enabling to return to injection of ions in the step 1) again. Mass spectra of ions generated by the ion source are acquired by repeating the steps of 1) to 3).

Step 3: Mass Calibration of Product Ions Obtained by MS/MS

Prior to accurate mass determination of the analyte sample, the product ions of the analyte sample in the mass spectrum acquired in Step 2 are calculated for their masses m1', m2', . . . from their respective flight times t1, t2, . . . according to Equation 3 that has been predetermined by mass calibration performed in Step 1.

$$m1'=at1^2+bt1+c \quad (5)$$

$$m2'=at2^2+bt2+c \quad (6)$$

On the other hand, the standard material ion is also calculated for the mass mr' from the flight time tr in a similar manner. Here, the standard material ion is selected so as to have a mass as close to the product ions as possible.

$$mr'=atr^2+btr+c \quad (7)$$

Since there is naturally a time interval between Step 1 and Step 2,the determined mr' differs from the true mr in case there are a temperature drift and the like.

Therefore, the ratio of mr' to mr is determined to use this value as a correction factor. In this way, an effect of the drift between Step 1 and Step 2 can be reduced.

$$r=mr/mr' \quad (8)$$

$$m1=m1'*r \quad (9)$$

$$m2=m2'*r \quad (10)$$

According to the foregoing procedure, the masses m1, m2, . . . of the product ions of the analyte sample (P1, P2, . . . ) can be determined as accurate masses after correction.

It should be noted that ions generated from a sample solution itself can also be used as the standard material ions without injecting the sample solution and the standard material solution together into the ion source. Very minute amounts of $Na^+$ ion and $K^+$ ion contained in the sample solution can be taken out as gaseous ions by the ESI ion source. Further, cluster ions that are adducts of solvent molecules with $Na^+$ ion and $K^+$ ion are often generated. When the solvent molecule is represented by S, $Na^+$ and $Na(S)n^+$ ions appear in a low mass range. These ions can be used as lock mass ions, thereby eliminating the inconvenience of injecting the sample solution and the standard material solution into the ESI ion source at the same time.

Although, in the present embodiment, an example in which the standard material ion (mr) is one is described, a plurality of standard material ions differing in their masses may also be used. In this case, the plurality of standard material ions (mr) differing in their masses can be left in the ion trap by applying white noise with a plurality of notches as the supplementary AC.

Accuracy of accurate mass determination in a wide mass range can be improved by using a standard material ion (mr) that gives a mass closest to the sample ion as a lock mass ion.

Second Embodiment

Since there is a time interval between Step 1 and Step 2 in the first embodiment, a drift of the parameters a, b, and c in Equation 3 due to the time elapsed must be considered. On the other hand, when standard material ions are made plural to improve the accuracy, it is necessary to increase notches in response to an increase in the standard material ions, thus giving rise to a possibility that isolation of a precursor ion becomes inefficient. Hence, in the present embodiment, a method is presented in which not only is Step 1 in the first embodiment rendered unnecessary but also the efficiency of isolation of the precursor ion (mp) is not reduced by making the standard material ion (mr) isolated with the precursor ion (mp) only one.

The measurement in the present embodiment is carried out by the following two steps:

Step A: Simultaneous measurement of standard material and analyte sample, and MS/MS Step B: Mass calibration of product ions obtained by MS/MS Hereinafter, each step is explained.

Step A: Simultaneous Measurement of Standard Material and Analyte Sample, and MS/MS 1) Ion Introduction and Accumulation The sample and the standard material are ionized by the ion source, introduced into and accumulated in the ion trap in the same manner as that in the first embodiment.

For the standard material, a material that generates cluster ions in a wide mass range as described in the first embodiment. The material includes organic acid alkali metal salts and halogenated alkali metal salts.

2) MS/MS (Isolation of the Precursor Ion (mp) and the Standard Material Ion (mr))

At the time of isolating a precursor ion, white noise with plural notches is applied. The precursor ion mp and a standard ion mr are trapped in the ion trap, and all other mass ions are ejected. The standard material is chosen on the ground that the standard material ion mr gives cluster ions with high intensity in a mass range that includes the precursor ion mp.

Figure 4A:
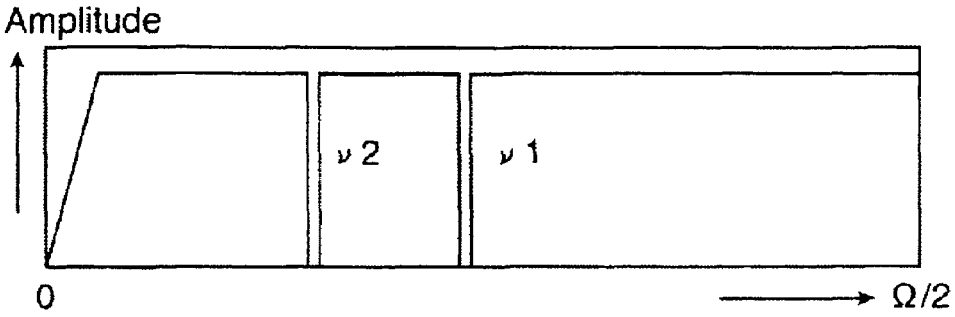
FIG. 4A depicts a power spectrum of a supplementary AC voltage for use in ion isolation in a second embodiment.

FIG. 4 shows a power spectrum of white noise that is applied to the endcap electrodes to isolate the ions. The white noise with plural notches (ν1, ν2) as shown FIG. 4A is applied to the endcap electrodes 14 and 19 in the ion trap. The precursor ion (mp) and the standard material ion (mr) corresponding to the notches (ν1, ν2) are left behind in the ion trap, and all other ions are ejected.

3) MS/MS (CID of the Precursor Ion (mp) and the Standard Material Ion (mr))

Figure 4B:
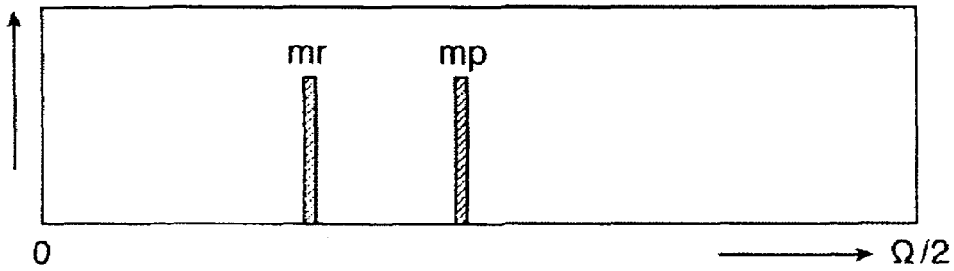
FIG. 4B depicts CID excitation of a precursor ion and a standard material ion in the second embodiment.
Figure 5A:
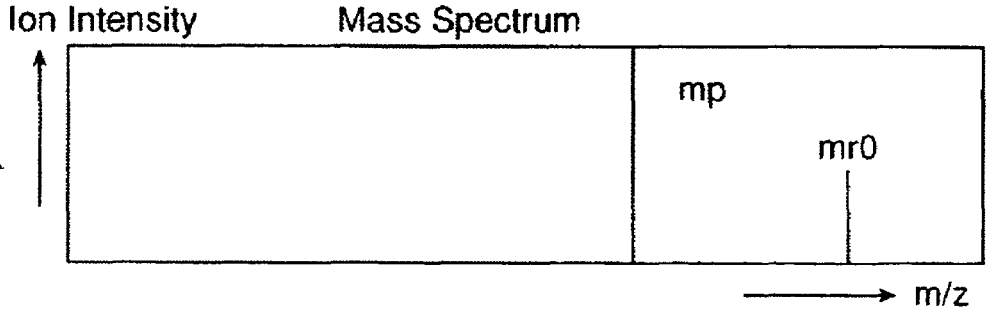
FIG. 5A is a mass spectrum of isolated ions in the second embodiment.
Figure 5B:
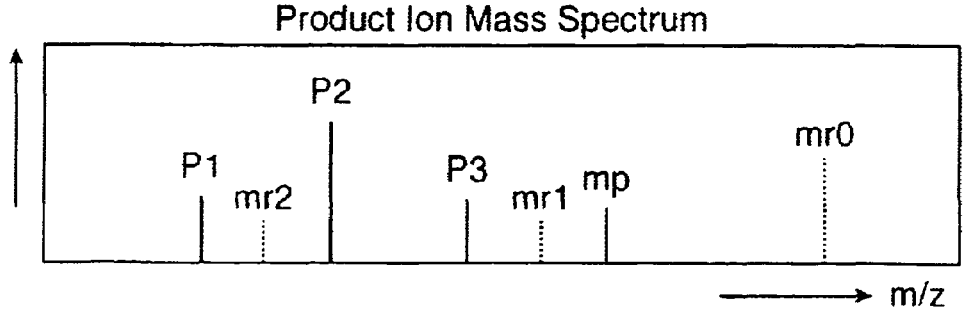
FIG. 5B is a mass spectrum of product ions after the CID excitation in the second embodiment.

After isolating these ions, a supplementary AC voltage with two frequencies (ν1, ν2) corresponding to mp and mr as shown in FIG. 4B is applied to excite simultaneously the precursor ion (mp) and the standard material ion (mr) and dissociate them. In this CID step, the standard material ion (mr) is also excited and dissociated, which is different from the first embodiment. As the result, the precursor ion (mp) is dissociated to generate product ions (P1, P2, P3, . . . ) as shown in FIG. 5.

$$mp^+ \rightarrow P1^+ + (mp-P1) \quad (11)$$

On the other hand, the standard material ion mr0 is dissociated to generate a plurality of product ions (mr1, mr2, . . . ).

When sodium trifluoroacetate is used as the standard sample, it gives cluster ions by CID according to the equation below.

$$(CF_3CO_2Na)_nNa^+ \rightarrow (CF_3CO_2Na)_{n-1}Na^+ + (CF_3CO_2Na)_{n-2}Na^+ + \quad (12)$$

When a cluster ion of sodium trifluoroacetate (n=10) having a mass of 1383 is isolated and then dissociated by CID as above, cluster ions having masses of 1247, 1111, 975 and so on are generated as its product ions.

$$(CF_3CO_2Na)_{10}Na^+ \rightarrow (CF_3CO_2Na)_9Na^+ + (CF_3CO_2Na)_8Na^+ + \quad (13)$$

In this manner, plural cluster ions are produced from one cluster ion of the standard material ion. The masses of these plural cluster ions are known. In general, plural ions (mr1, mr2, . . . ) differing in masses are generated from a cluster ion $(CF_3CO_2Na)_nNa^+$ from which neutral $CF_3CO_2Na$ molecule is dissociated by n=1 to 4.

4) TOF Measurement

The ions after the above MS/MS step are measured by TOF. The obtained mass spectrum is a mixed mass spectrum including the product ions (P1, P2, P3, . . . ) from the sample ion, the standard material ions (mr1, mr2, . . . ), the precursor ions (mp, mr0) that could not be dissociated by CID, and the like.

Step B: Mass Calibration of Product Ions Obtained by MS/MS

From this mixed mass spectrum, a plurality of ions with known masses (mr0, mr1, mr2, . . . ) are chosen, and mass calibration is carried out based on these ions. In the present embodiment, mass calibration in which the parameters a, b, and c in Equation 3 are determined using a plurality of ions with known masses is carried out in every measurement.

In other words, the constants a, b, and c in Equation 3 are determined for every mass spectrum, and then flight times t1, t2, t3, . . . of product ions (P1, P2, P3, . . . ) are substituted into Equation 3 as determined above, thereby allowing accurate masses of the product ions to be determined.

In the present embodiment, the isolation of two ions, the precursor ion (mp) and the standard material ion (mr), in the MS/MS step will suffice. Since a plurality of ions with known masses are generated from a single standard material ion (mr), it becomes unnecessary to increase notches one after another for standard materials, and the risk of contamination of unnecessary ions and interfering ions in the ion trap can be minimized.

It should be noted that cluster ions of organic acid alkali metal salts and halogenated alkali metal salts were used in the description of the embodiment. However, the standard material may be not only an alkali metal salt but also any known organic material as long as it gives a precursor ion with a known mass and product ions with known masses by CID and is thus usable for a standard material. Although mass calibration with the latter is not possible over a wide mass range as in the case of cluster ions, it can be applied to accurate mass determination of many unknown samples. Furthermore, a non-ionic surfactant such as polyethylene glycol (PEG) or polypropylene glycol (PPG) gives mass peaks that are equally spaced over a wide range. Since the non-ionic surfactants give product ions with known masses by CID as in the case of alkali metal salts, these can be used as the standard material in a manner similar to alkali metal salts and halogenated alkali metal salts.

What is claimed is:

1. A method for accurate mass determination with ion trap/time-of-flight mass spectrometer provided with an ion source to ionize a sample, an ion trap to trap a plurality of ions differing in masses, and a time-of-flight mass spectrometer, the method for accurate mass determination with ion trap/time-of-flight mass spectrometer comprising steps of:

generating ions of an analyte sample and a standard material by the ion source;

introducing the ions of the analyte sample and the standard material together into the ion trap to trap them;

selecting a precursor ion from among the ions of the analyte sample to leave the precursor ion and a standard material ion in the ion trap and eliminate other ions;

exciting and dissociating the precursor ion to generate product ions;

ejecting the precursor ion, the product ions, and the standard material ion trapped in the ion trap to introduce these ions from the ion trap into the time-of-flight mass spectrometer; and measuring a mass spectrum in the time-of-flight mass spectrometer, wherein correction for accurate masses of the product ions is carried out based on the standard material ion measured.

2. The method for accurate mass determination with ion trap/time-of-flight mass spectrometer according to claim 1, further comprising steps of:

ionization of the standard material with known accurate mass to measure flight times of a plurality of standard material ions in the time-of-flight mass spectrometer; and mass calibration to determine constants a, b, and c in the equation below from the plurality of the standard material ions, $$M=at^2+bt+c$$

(M: mass, t: time).

3. The method for accurate mass determination with ion trap/time-of-flight mass spectrometer according to claim 2, wherein the correction for accurate masses of the product ions generated from the precursor ion is carried out by substituting flight times (t) of the product ions measured by the time-of-flight mass spectrometer into the equation used in the step of mass calibration.

4. The method for accurate mass determination with ion trap/time-of-flight mass spectrometer according to claim 2, wherein the plurality of the standard material ions are cluster ions.

5. The method for accurate mass determination with ion trap/time-of-flight mass spectrometer according to claim 1, wherein the standard material ion is $Na^+$ ion, $K^+$ ion, or any adduct of solvent molecules with these ions.

6. A method for accurate mass determination with ion trap/time-of-flight mass spectrometer provided with an ion source to ionize a sample, an ion trap to trap a plurality of ions differing in masses, and a time-of-flight mass spectrometer, the method for accurate mass determination with ion trap/time-of-flight mass spectrometer comprising steps of:

generating ions of an analyte sample and a standard material by the ion source;

introducing the ions of the analyte sample and the standard material together into the ion trap to trap them;

selecting a precursor ion from among the ions of the analyte sample to leave the precursor ion and a standard material ion in the ion trap and eliminate other ions;

exciting and dissociating the precursor ion and the standard material ion to generate product ions;

ejecting the precursor ion, the standard material ion, and their product ions trapped in the ion trap to introduce these ions from the ion trap into the time-of-flight mass spectrometer; and measuring a mass spectrum in the time-of-flight mass spectrometer, wherein correction for accurate masses of the product ions generated from the precursor ion is carried out based on the standard material ion and its product ions measured.

7. The method for accurate mass determination with ion trap/time-of-flight mass spectrometer according to claim 6, further comprising a step of mass calibration in which constants a, b, and c in the equation below are determined for every measurement of the mass spectrum using the product ions of the standard material, $$M=at^2+bt+c$$

(M: mass, t: time).

8. The method for accurate mass determination with ion trap/time-of-flight mass spectrometer according to claim 7, wherein the correction for accurate masses of the product ions generated from the precursor ion is carried out by substituting flight times (t) of the product ions generated from the precursor ion measured by the time-of-flight mass spectrometer into the equation used in the step of mass calibration.

9. The method for accurate mass determination with ion trap/time-of-flight mass spectrometer according to claim 6, wherein the ions of the standard material are cluster ions.

10. The method for accurate mass determination with ion trap/time-of-flight mass spectrometer according to claim 9, wherein the standard material is any one of a halogenated alkali metal salt, organic acid alkali metal salt, and non-ionic surfactant such as polyethylene glycol.

* * * * *